US006694777B2

(12) United States Patent
Lampe

(10) Patent No.: US 6,694,777 B2
(45) Date of Patent: Feb. 24, 2004

(54) SETTING

(75) Inventor: Markus Lampe, Hall (AT)

(73) Assignee: D. Swarovski & Co., Wattens (AT)

( * ) Notice: Subject to any disclaimer, the term of this patent is extended or adjusted under 35 U.S.C. 154(b) by 0 days.

(21) Appl. No.: 10/224,423

(22) Filed: Aug. 21, 2002

(65) Prior Publication Data

US 2003/0041622 A1 Mar. 6, 2003

(30) Foreign Application Priority Data

Sep. 6, 2001 (AT) ..... 1406/2001

(51) Int. Cl.[7] ..... A44C 17/02
(52) U.S. Cl. ..... 63/26; 63/3
(58) Field of Search ..... 63/26, 3

(56) References Cited

U.S. PATENT DOCUMENTS 795,109 A * 7/1905 Dover ..... 63/26
983,295 A * 2/1911 Lawson ..... 63/26
2,035,244 A * 3/1936 Pejchar ..... 63/26
2,510,774 A * 6/1950 Engel ..... 63/26
5,687,586 A 11/1997 Facini
5,694,791 A * 12/1997 Esposito ..... 63/3
5,800,574 A * 9/1998 Ricci et al. ..... 29/10

FOREIGN PATENT DOCUMENTS

GB 2136672 9/1984

* cited by examiner

*Primary Examiner*—Andrea Chop
(74) *Attorney, Agent, or Firm*—Wenderoth, Lind & Ponack, L.L.P.

(57) ABSTRACT

A setting, in particular for decorative stones made of cut glass, is made of stamped sheet metal. It receives the decorative stone in the manner of a cup, the setting surrounding the stone in the area of its greatest diameter in the manner of a channel. At least the upper edge (3) of the setting (2) clasping the decorative stone (1) has a reduced metal sheet thickness.

7 Claims, 5 Drawing Sheets

SETTING

BACKGROUND OF THE INVENTION

The present invention relates to a setting, in particular for decorative stones made of cut glass, made from stamped sheet metal, which receives the decorative stone in the manner of a cup, wherein the setting encloses the decorative stone in the area of its greatest diameter in the manner of a channel, and to a method of manufacture relating to this.

Settings of the type described are already known from U.S. Pat. No. 4,972,685, wherein the embodiments in this document fix the decorative stone by means of channel-shaped areas or individual claws. Fixing by means of individual claws is disadvantageous to the extent that these claws bend even with a small amount of force. If the settings described are joined together to form a so-called kessel chain, the projecting claws scratch and prick the wearer of the jewellery, or pull threads on clothing. Although retention by means of channel-shaped areas, which are preferable, is described in U.S. Pat. No. 4,972,685, it was difficult to implement because of the difficulty in deforming the sheet metal that has to be applied as "gently" as possible to the delicate decorative stone.

SUMMARY OF THE INVENTION

In this connection, the present invention provides that at least the upper edge of the setting, clasping over the decorative stone, has a reduced metal sheet thickness.

In order to manufacture this setting, the method according to the invention provides that the sheet metal forming the setting is deep drawn with a die with areas having different diameters.

The reduced metal sheet thickness provided at least in the area of the upper edge of the setting clasping over the decorative stone considerably facilitates the matching of the setting to the decorative stones, even when operating with generous tolerances in the fabrication of the decorative stones and settings.

It is provided in particular that the metal sheet thickness is reduced to at least 75%, and preferably to approximately 50%.

In order to avoid the decorative stone being able to slip downwards, in the situation in which its tip does not touch the base of the setting, it is preferable that the setting project outwards in the area in which it surrounds the greatest diameter of the decorative stone in the manner of a channel.

BRIEF DESCRIPTION OF THE DRAWINGS

Further features and details of the present invention will be evident from the description of the drawings. In these is shown, in.

DETAILED DESCRIPTION OF THE PREFERRED EMBODIMENT

Figure 2:
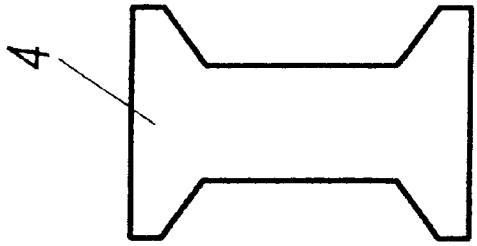
Figure 1:
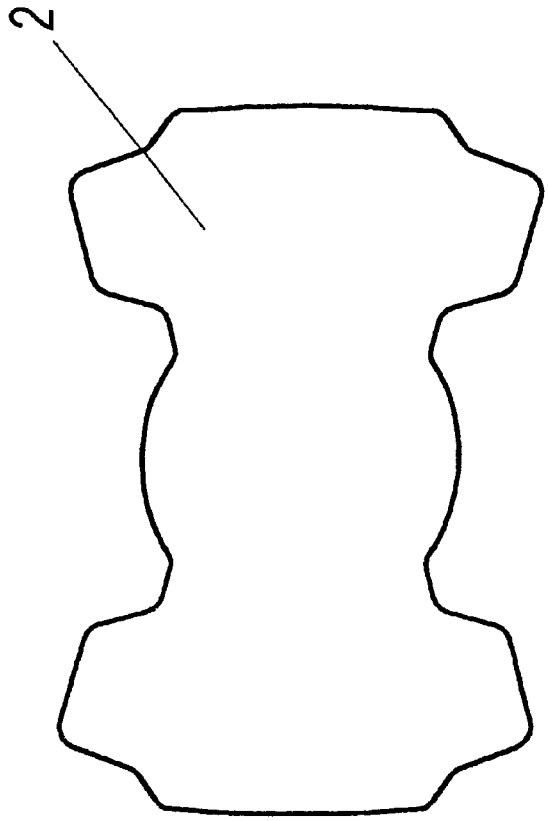
FIG. 1, a setting according to the invention in its raw state after being stamped out, FIG. 2, a connecting element, FIG. 3, a first instantaneous image of a deep drawing procedure, in section, FIG. 4, a second instantaneous image of the deep drawing procedure in section, FIG. 5, the completed setting with a decorative stone set in and the connecting element, in section, and FIG. 6, a kessel chain composed of settings according to the invention.

FIG. 1 shows a setting 2 according to the invention made from sheet metal, after stamping it out but still in its flat state. FIG. 2 shows a fastening element 4 that is arranged between two respective settings 2, where the settings 2 are to be connected together to form a kessel chain. The preferred type of sheet metal from which settings 2 and connecting elements 4 are stamped is sheet brass.

Figure 3:
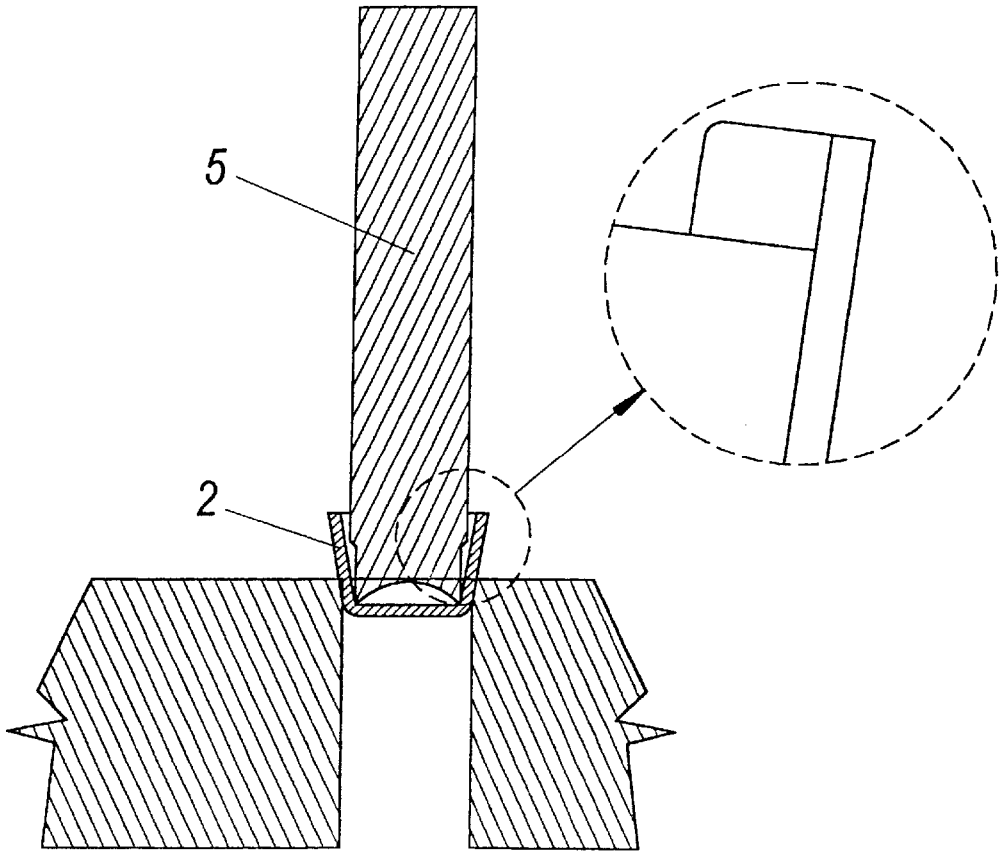
Figure 4:
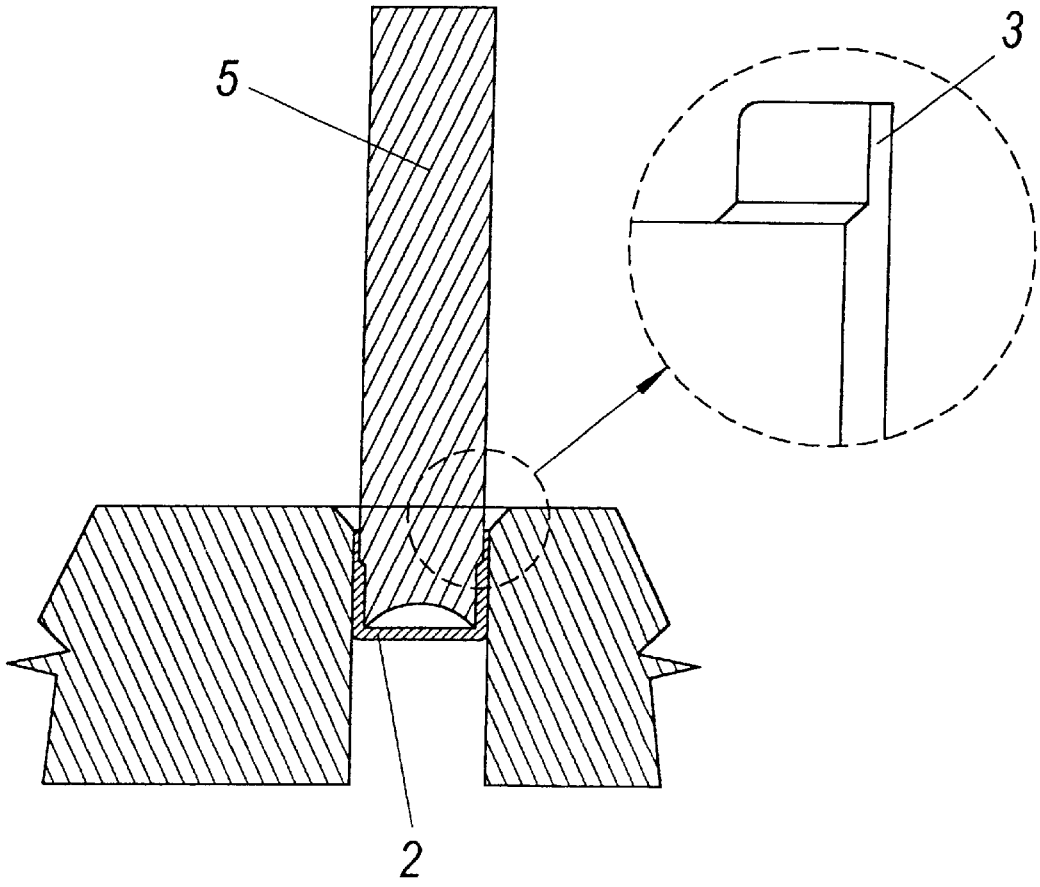

It is important that the upper edge 3 of the settings 2 according to the invention has a reduced metal sheet thickness. FIGS. 3 and 4 show the deep drawing procedure provided for this. The die 5 used in deep drawing has, in its front area, a smaller diameter than further back. This means that during deep drawing the initially flat piece of sheet metal forming the setting 2 is not only made into a cup shape, but at the same time the wall thickness on the upper edge 3 of the setting 2 is reduced. The remaining wall thickness should be less than three-quarters, preferably approximately half the original sheet metal thickness.

The setting is made from stamped sheet metal having an original thickness and two opposite ends, as seen in FIG. 1. The sheet metal is then formed into a shape having separate and discrete setting halves from the two opposite ends, respectively, that together are capable of receiving and cupping the decorative stone. This is clear from the described process and the setting as illustrated in the various drawing figures.

Figure 5:
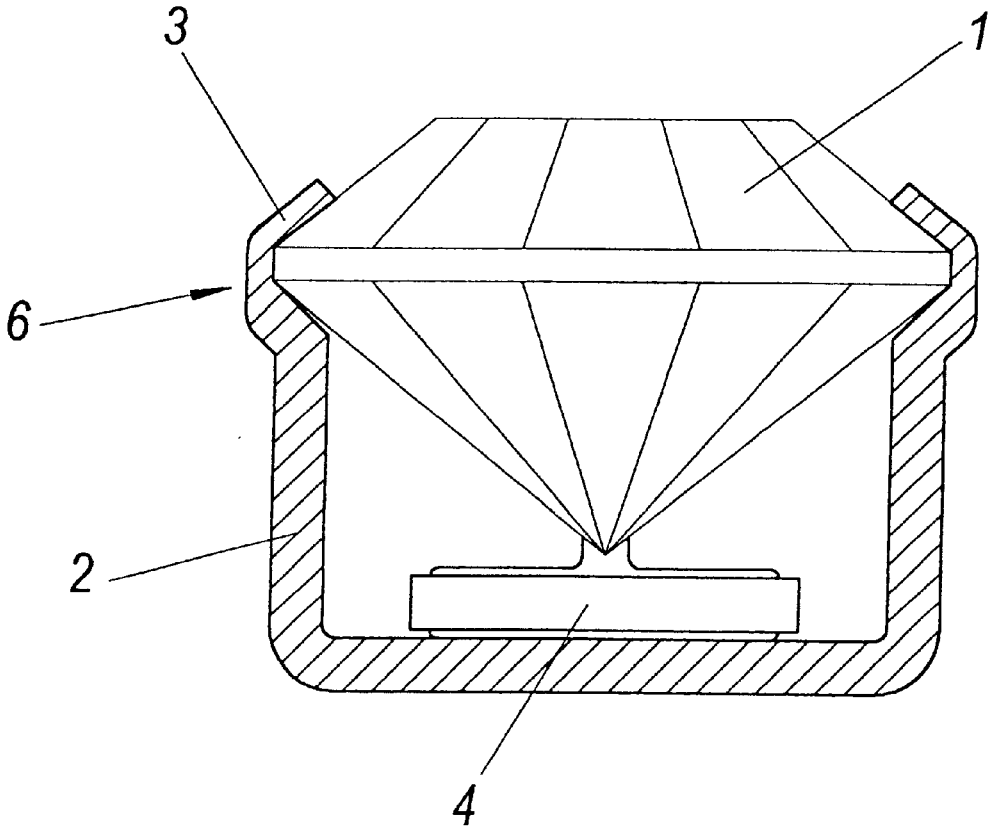

In a further deep drawing procedure (not shown) a projection 6 is produced, so that in the end there is the setting 2 shown in FIG. 5. In FIG. 5 the setting 2 is already provided with a decorative stone 1. The thinned upper edge 3 of the setting 2 adapts itself optimally to a cut glass decorative stone 1. The decorative stone 1 rests downwardly upon the projection 6, whereby downward slipping of the decorative stone 1 is prevented.

Figure 6:
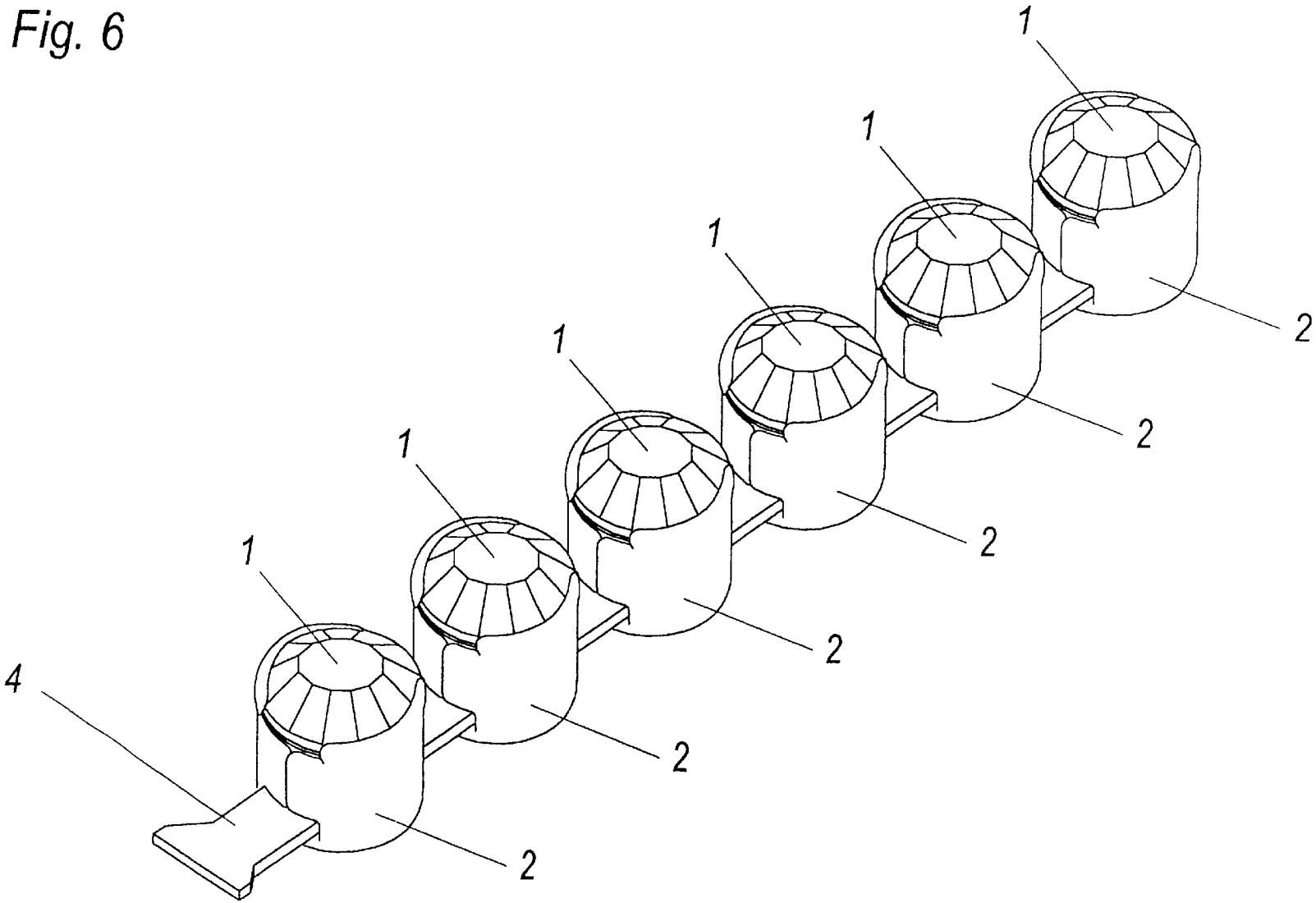

By inserting the connecting elements 4 in the base area of the settings 2 prior to setting in the decorative stones 1, kessel chains can be produced in a normal manner, as is shown in FIG. 6.

What is claimed is:

1. A setting for decorative stones made of stamped sheet metal structured and arranged to be capable of receiving the decorative stone so as to cup the decorative stone, wherein said setting, upon receiving the decorative stone, surrounds the decorative stone in an area of greatest diameter of the decorative stone with a channel, wherein at least an upper edge of said setting, adapted to clasp the decorative stone, has a reduced metal sheet thickness, and wherein said setting projects outwardly, in the area thereof that surrounds the greatest diameter of the decorative stone with said channel partly formed by said upper edge of said setting and with said upper edge having the reduced metal sheet thickness.

2. The setting of claim 1, wherein said upper edge of said setting partly forming the channel has a reduced metal sheet thickness that has been reduced to a thickness no greater than 75% of the original metal sheet thickness.

3. A kessel chain composed of a row of settings connected by connecting elements, wherein each setting of said row of settings is made of stamped sheet metal structured and arranged to be capable of receiving a decorative stone so as to cup the decorative stone, wherein said setting, upon receiving the decorative stone, surrounds the decorative stone in an area of greatest diameter of the decorative stone with a channel, wherein at least an upper edge of said setting, adapted to clasp the decorative stone, has a reduced metal sheet thickness, and wherein said setting projects outwardly, in the area thereof that surrounds the greatest diameter of the decorative stone with said channel partly formed by said upper edge of said setting and with said upper edge having the reduced metal sheet thickness.

4. A setting for receiving a decorative stone, said setting being made from stamped sheet metal having an original thickness and two opposite ends so as to form a shape having separate and discrete setting halves from said two opposite ends, respectively that together are capable of receiving and cupping the decorative stone, and include a channel portion adapted to surround a greatest diameter portion of the decorative stone, wherein an upper edge portion of each setting half has a metal sheet thickness reduced from the original thickness, and a body portion below said channel portion, wherein the setting halves project outwardly with respect to said body portion at said channel portion of said upper edge portion adapted to surround a greatest diameter portion of the decorative stone.

5. The setting of claim 4, wherein the metal sheet thickness of said upper edge portion is reduced to a thickness no greater than 75% of the original metal sheet thickness.

6. The setting of claim 4, wherein said body portion is substantially cylindrical and wherein said upper edge portion, at which the setting projects outwardly of said body portion, comprises two upper edge arc portions each of which projects radially outwardly of said body portion.

7. A kessel chain composed of a row of settings connected by connecting elements, wherein each setting of said row of settings is made by the process of stamping sheet metal having an original thickness so as to form a shape capable of receiving and cupping a decorative stone and include a channel portion adapted to surround a greatest diameter portion of the decorative stone, wherein an upper edge portion of each setting half has a metal sheet thickness reduced from the original thickness, and a body portion below said channel portion, wherein the setting halves project outwardly with respect to said body portion at said channel portion of said upper edge portion adapted to surround a greatest diameter portion of the decorative stone.

* * * * *